United States Patent [19]

Gannaway et al.

[11] Patent Number: 4,889,475

[45] Date of Patent: Dec. 26, 1989

[54] TWIN ROTARY COMPRESSOR WITH SUCTION ACCUMULATOR

[75] Inventors: Edwin L. Gannaway, Adrian; Arturo L. Ortiz, Tecumseh, both of Mich.

[73] Assignee: Tecumseh Products Company, Tecumseh, Mich.

[21] Appl. No.: 138,558

[22] Filed: Dec. 24, 1987

[51] Int. Cl.[4] ..... F04B 23/04

[52] U.S. Cl. ..... 417/350; 417/360; 417/902; 418/210

[58] Field of Search ..... 417/902, 372, 360, 350, 417/310, 319; 403/282, 396, 326; 418/151, 88, 210

[56] References Cited

U.S. PATENT DOCUMENTS

| | | | |
|---|---|---|---|
| 1,078,301 | 11/1913 | Moore | 418/210 |
| 2,178,100 | 10/1939 | Gygax . | |
| 2,203,525 | 6/1940 | Dupree, Jr. | 415/170 A |
| 2,239,723 | 4/1941 | Limpert et al. | 417/902 |
| 2,793,506 | 5/1957 | Moody . | |
| 2,814,254 | 11/1957 | Litzenberg . | |
| 2,845,867 | 8/1958 | Shoosmith | 418/210 X |
| 3,022,642 | 2/1962 | Long . | |
| 3,077,088 | 2/1963 | Japhet . | |
| 3,094,272 | 6/1963 | McClure . | |
| 3,386,262 | 6/1968 | Hackbart et al. . | |
| 3,411,707 | 11/1968 | Zoehfeld | 415/170 A |
| 3,503,223 | 3/1970 | Parker . | |
| 3,672,793 | 6/1972 | Yowell . | |
| 3,673,777 | 7/1972 | Weber | 403/282 X |
| 3,743,451 | 7/1973 | Chapman | 418/151 X |
| 3,785,169 | 1/1974 | Gylland, Jr. . | |
| 3,969,044 | 7/1976 | Füssner et al. | 417/410 |
| 4,065,219 | 12/1977 | Levine | 403/287 |
| 4,091,638 | 5/1978 | Mitch | 417/902 X |
| 4,102,149 | 7/1978 | Conley et al. . | |
| 4,105,374 | 8/1978 | Scharf . | |
| 4,157,225 | 6/1979 | Levine | 403/287 |
| 4,184,341 | 1/1980 | Friedman . | |
| 4,205,537 | 6/1980 | Dubberley . | |
| 4,277,955 | 7/1981 | Parker . | |
| 4,354,808 | 10/1982 | Ilg | 403/326 X |
| 4,411,141 | 10/1983 | Hara . | |
| 4,505,650 | 3/1985 | Hannett et al. . | |
| 4,554,795 | 11/1985 | Ibrahim . | |
| 4,569,645 | 2/1986 | Asami et al. | 417/902 |
| 4,591,318 | 5/1986 | Elson . | |
| 4,614,453 | 9/1986 | Tsuno et al. | 416/241 BX |
| 4,644,207 | 2/1987 | Catterfeld et al. . | |

FOREIGN PATENT DOCUMENTS

| | | | |
|---|---|---|---|
| 1910325 | 9/1970 | Fed. Rep. of Germany | 418/210 |
| 273498 | 4/1930 | Italy | 417/350 |
| 59-28085 | 2/1984 | Japan | 418/88 |
| 62-68895 | 11/1986 | Japan | 417/902 |
| 132989 | 7/1929 | Switzerland | 417/350 |

*Primary Examiner*—Carlton R. Croyle
*Assistant Examiner*—Eugene L. Szczecina, Jr.
*Attorney, Agent, or Firm*—Albert L. Jeffers; John F. Hoffman; David L. Ahlersmeyer

[57] ABSTRACT

A hermetically sealed twin rotary compressor is disclosed wherein a pair of rotary vane compressors are synchronously, coaxially coupled to respective axial ends of a drive motor by a quill disposed in a rotatable rotor thereof. The rotary compressor crankshafts are coupled to the quill with their eccentric portion oriented opposite one another with respect to the axis of rotation. Counterbalancing weights are mounted to the motor end rings oppositely the adjacent eccentric portion with respect to the axis of rotation. A suction accumulator is provided having a pair of tubes extending from fluid outlets on the accumulator to respective fluid inlets associated with the pair of compressors. The tubes pass through a pair of spaced apertures in the housing and effectively mount the suction accumulator to the housing. A method of assembling the compressor assembly, including accumulator, is also disclosed.

14 Claims, 2 Drawing Sheets

TWIN ROTARY COMPRESSOR WITH SUCTION ACCUMULATOR

BACKGROUND OF THE INVENTION

This invention pertains to hermetically sealed, positive displacement compressors for compressing refrigerant in refrigeration systems such as air conditioners, refrigerators, and the like. In particular, the invention relates to multi-unit compressor assemblies wherein a plurality of compressors are housed in a common hermetic shell.

Various positive displacement compressors for use in refrigeration systems are known in the art. For example, reciprocating piston, rotary vane, and scroll type compressors have been incorporated into the various hermetic compressor assemblies. Each of these compressor types typically includes an electric motor drivingly connected to a crankshaft having an eccentric portion thereon. During operation of each of the aforementioned compressors, a piston means such as a cylindrical piston, a roller, or an orbiting scroll is operatively driven by the eccentric portion of the rotating crankshaft to compress refrigerant within a compression chamber. In a hermetic compressor assembly having a pressurized or high side sealed housing, the compressed gas from within the compression chamber is discharged into the compressor housing.

Certain refrigeration system applications require a compressor assembly having a greater displacement capacity than is typically available from standard application compressor units. To meet this need for greater capacity, a single positive displacement compressor may be made physically larger, thereby increasing its displacement. Alternatively, it is known to supply a single refrigeration system with a pair of motor-compressor units connected in parallel to the system, whereby either unit may be cycled on and off to vary the capacity of the system. In this latter approach, the two motor-compressor units are of the vertical shaft type and are mounted within a single housing in spaced parallel relationship to one another.

A disadvantage that often results from the prior art solution wherein a single larger compressor is used, is an increased incidence of vibration, noise, and operating inefficiency. In the case of a compressor having a single piston means, the increased physical size results in greater vibration. Increased amplitude noise pulses are produced by a larger capacity compressor as the result of greater mass flow rates of compressed gas through discharge passages. Several factors in a physically larger compressor contribute to operating inefficiencies, one notable factor being the increase in power losses due to increased friction from larger bearings required to support the necessary larger crankshaft. Furthermore, inherently inefficient motor loading for a single piston compressor is further degraded due to the greater operating range required of the motor and the possibility of overload at high end loading.

In order to decrease vibration in a single motor compressor unit, it is known to increase the number of compression chambers and pistons. However, several problems and disadvantages are associated with this approach. For example, in a reciprocating piston type compressor the addition of more pistons and cylinders requires a longer crankshaft having multiple eccentric portions. Besides the added size, complexity, and expense of increasing the number of cylinders, there are problems associated with increased crankshaft length. One such problem is what is known as rotor whip, wherein the rotor of the electric motor exhibits radial variations which cause difficulties in maintaining a proper air gap between the motor, rotor and stator. Also, a greater crankshaft length may require an increased number of bearings, thereby adding further to the expense and complexity of the compressor.

A multi-unit system is often more efficient and less expensive to manufacture and operate than a larger single unit of the same capacity. However, the prior art multi-unit systems remain complex and expensive due to the typical modular design wherein separate independently operating motor-compressor units are mounted within a single housing. In such an arrangement, a large housing is required and very few dimensional efficiencies are gained. This is due primarily to the need for multiple electric motors to drive the multiple compressor units.

In the prior art multi-unit compressor assemblies it is known to provide a single suction accumulator within the hermetically sealed housing. In such an arrangement, either the suction inlet tubing is connected between the suction accumulator and the individual compressor units, or the interior of the housing is at suction pressure, thus obviating the need for tubing connecting the accumulator to the compressor. A disadvantage of having the suction accumulator mounted within the housing is that additional space within the housing is required, as well as additional tubing. Furthermore, the suction accumulator is subjected to the hotter operating environment within the housing.

SUMMARY OF THE INVENTION

The present invention overcomes the disadvantages of the above-described prior art multi-unit compressor assemblies by providing a hermetically sealed compressor assembly wherein multiple positive displacement compressors are synchronously coupled to and driven by a single drive means.

Generally, the invention provides, within a hermetically sealed housing, a pair of rotary vane compressors having rotary crankshafts associated therewith, and an electric motor having a rotatable rotor. The crankshaft of each compressor is coaxially coupled to the rotor at a respective end thereof, and is synchronously driven thereby.

More specifically, the invention provides, in one form thereof, a twin rotary compressor assembly wherein a pair of rotary vane compressors are operably mounted to opposite ends of the rotor of an electric motor disposed within a hermetic shell. A quill within the rotor provides means for coupling the crankshafts to the rotor. The compressor crankshafts include respective eccentric portions that are oriented opposite one another with respect to the common motor and compressor axis of rotation. Gas refrigerant is supplied to a fluid inlet of each of the compressors from a common suction accumulator mounted externally of the compressor assembly housing. The accumulator includes two fluid outlets, and a pair of conduits extend through a pair of spaced apertures in the housing to provide fluid communication between each of the fluid outlets and a respective fluid inlet.

A primary advantage of the twin rotary compressor of the present invention is that this arrangement allows use of the same tooling to double the capacity range for a given rotary compressor family with a minimum variation in component parts. Accordingly, the multi-unit compressor assembly of the present invention yields manufacturing simplicity, flexibility, and efficiencies not realized by prior art multi-unit compressors.

Another advantage of the present invention is that a smaller multi-unit compressor assembly is achieved by the provision of a single drive motor coupled to two compressor mechanisms, thus decreasing space requirements within the hermetic housing.

Yet another advantage of the present invention is that a quieter compressor assembly is achieved through the combination of two smaller compressors, rather than a larger single unit.

A further advantage of the present invention is that less vibration, i.e., rocking, is generated by two compressor mechanisms wherein their eccentric portions counterbalance one another, as opposed to larger single units or non-synchronous multi-unit assemblies.

A still further advantage of the present invention is that a pair of smaller, inherently more efficient compressor mechanisms provide the same displacement capacity as larger single compressor units more efficiently and with less vibration and noise.

Another advantage achieved by the structure of the present invention is that by coaxially coupling the crankshafts of a pair of compressors to opposing ends of the motor rotor; rotor whip associated with long continuous shaft arrangements is prevented and, accordingly, maintenance of a proper rotor air gap is facilitated.

Yet another advantage of the present invention is that greater compressor capacity is achieved without increasing the size of bearings, which would ordinarily cause an accompanying increase in friction and decrease in operating efficiency.

A further advantage of the twin rotary compressor of the present invention is that the use of one larger motor is more efficient from a mechanical motor geometry standpoint and, furthermore, the larger motor operates more efficiently with the motor loading of the present invention wherein, during each rotation of the rotor, two equal but out-of-phase compression strokes occur.

A still further advantage of the present invention resides in the act that a single accumulator, externally mounted to the compressor housing, is capable of providing gas refrigerant to a pair of rotary compressors through a pair of spaced apertures in the housing.

Another advantage of the present invention is the provision of an adjustable accumulator capable of supplying gas refrigerant to a pair of spaced compressors within a housing, where the spacing between the compressors may vary according to model variations.

Still another advantage of the present invention is that an externally situated accumulator having two conduits entering the hermetic housing and being attached thereto, does not require a mounting bracket, thus reducing material and manufacturing costs of the compressor assembly.

The hermetic compressor assembly of the present invention, in one form thereof, comprises a housing, drive means disposed within the housing, and a pair of positive displacement compressors. The drive means is for providing a pair of synchronous axially opposed rotary outputs. Each of the pair of compressors has a rotary input coupled to a respective one of the pair of rotary outputs.

There is further provided in one form of the present invention, a hermetic compressor assembly comprising a housing, an electric motor, and a pair of compressor mechanisms. The electric motor is operatively disposed within the housing and has a rotor rotatable about an axis of rotation. Each of the pair of compressors includes a crankshaft having an eccentric portion thereon. The invention further provides coupling means for coaxially coupling the crankshafts to the rotor in opposing axial directions along the axis of rotation, with the eccentric portions positioned opposite one another with respect to the axis of rotation.

The hermetic compressor assembly of the instant invention still further provides, in one form thereof, a housing with an electric motor operatively disposed therein and including a rotatable rotor having axially opposed ends. A pair of positive displacement compressor mechanisms is also provided wherein each of the mechanisms comprises a compression chamber, a crankshaft having an eccentric portion thereon, and piston means within the chamber drivingly connected to the eccentric portion for compressing gas within the compression chamber during a compression stroke. The invention still further provides coupling means for drivingly coupling each of the crankshafts to a respective axially opposed end of the motor rotor. The crankshafts are coupled to the rotor such that the completion of a compression stroke for one of the compressor mechanisms occurs 180° of crankshaft rotation out-of-phase with the completion of a corresponding compression stroke for the other compressor mechanism.

The invention still further provides, in one form thereof, a hermetic compressor assembly comprising a housing, a pair of compressor mechanisms within the housing, and an accumulator external of the housing. Each of the pair of compressor mechanisms has a fluid inlet and the accumulator has a pair of fluid outlets. The invention also provides means for providing fluid communication between respective fluid inlets and fluid outlets.

There is further provided, in one form of the present invention, a hermetic compressor assembly comprising a vertically upstanding cylindrical housing, a tubular storage vessel external to the housing, and conduit means for mounting the vessel to the housing axially parallel to and in closely spaced relationship therewith. The housing includes compressor means disposed therein and a pair of vertically spaced apertures through which gas refrigerant is supplied from outside of the housing to the compressor means. The storage vessel includes a vessel inlet and a pair of vessel outlets, wherein the outlets are located at respective opposite ends of the vessel. The conduit means further provides fluid communication between the vessel outlets and the housing apertures. Furthermore, the vessel outlets are spaced axially inwardly of the housing apertures.

The invention still further provides, in one form thereof, a method of assembling a multi-unit hermetic compressor, wherein the spacing between a pair of compressors within a housing is subject to model design variation. Furthermore, each of the pair of compressors has a fluid inlet associated therewith. The method of assembling the compressor assembly comprises a step of providing a pair of spaced apertures in the housing substantially adjacent to the fluid inlets of the compressors. A further step comprises providing telescopic accumulator means for supplying gas refrigerant to the pair of apertures. The accumulator means includes a vessel and a pair of conduits at least one of which is slidably engaged within an opening in the vessel. Each of the pair of conduits has at its distal end away from the vessel a fluid outlet. A further step of the method of assembling a multi-unit hermetic compressor is adjusting the telescopic accumulator means until the pair of fluid outlets are substantially aligned with the pair of apertures. A yet further step of the method of the present invention provides for inserting the distal ends of the pair of conduits through the apertures so that the pair of fluid outlets matingly engage the pair of fluid inlets, respectively, to establish fluid communication therebetween.

DESCRIPTION OF THE PREFERRED EMBODIMENT

Figure 1:
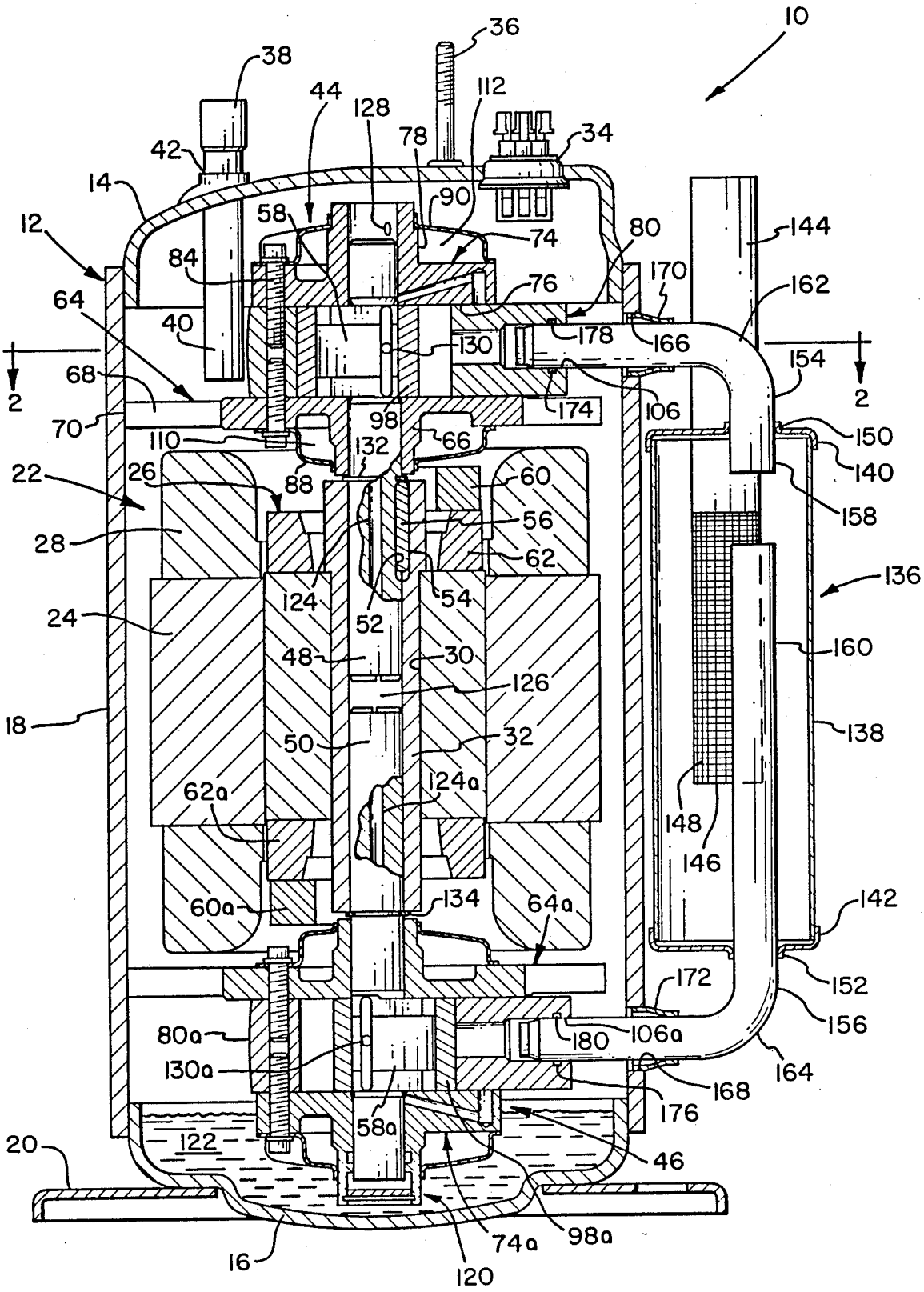
FIG. 1 is a side sectional view of a twin rotary compressor in accordance with the principles of the present invention.

In an exemplary embodiment of the invention as shown in the drawings, and in particular by referring to FIG. 1, a twin rotary compressor 10 is shown having a housing generally designated at 12. Housing 12 has a top portion 14, a lower portion 16 and a central portion 18. The three housing portions are hermetically secured together as by welding or brazing. A flange 20 is welded to the bottom of housing 10 for mounting the compressor. Located inside the hermetically sealed housing is a motor generally designated at 22 having a stator 24 and a rotatable rotor 26. The stator is provided with windings 28. Stator 24 is secured to housing 12 at substantially the axial center thereof by an interference fit, such as by shrink fitting. Rotor 26 has a central cylindrical bore 30 provided therein into which is secured a quill 32 by an interference fit. A terminal cluster 34 is provided on top portion 14 of the compressor for connecting the compressor to a source of electric power. A post 36 is welded to top portion 14 for mounting a protective cover (not shown) for terminal cluster 34.

A refrigerant discharge tube 38 extends through top portion 14 of the housing and has an end 40 thereof extending into the interior of the compressor as shown. The tube is sealingly connected to housing 10 at 42 as by soldering.

Twin rotary compressor 10, according to the preferred embodiment of the present invention shown in FIG. 1, includes a pair of rotary vane compressors 44 and 46 coupled to and drivingly engaged by rotor 26 of motor 22. More specifically, compressors 44 and 46 include respective crankshafts 48 and 50, which are received within opposing ends of quill 32 and are retained therein. As illustrated in FIG. 1, crankshaft 48 is secured against relative rotation with respect to quill 32 by key locking means comprising an axial slot 52 in crankshaft 50, a corresponding channel 54 in quill 32 axially aligned with slot 52, and a cylindrical key 56 engaging both slot 52 and channel 54 to prevent relative rotational movement therebetween. While shaft keys having different shapes may be utilized, the preferred embodiments is a cylindrical pin in an axial slot so as to provide line contact for less wear and better endurance. Alternatively, an axial spline arrangement or, preferably, a slip fit of the crankshaft into the quill together with a chemical bonding agent could be utilized.

Figure 2:
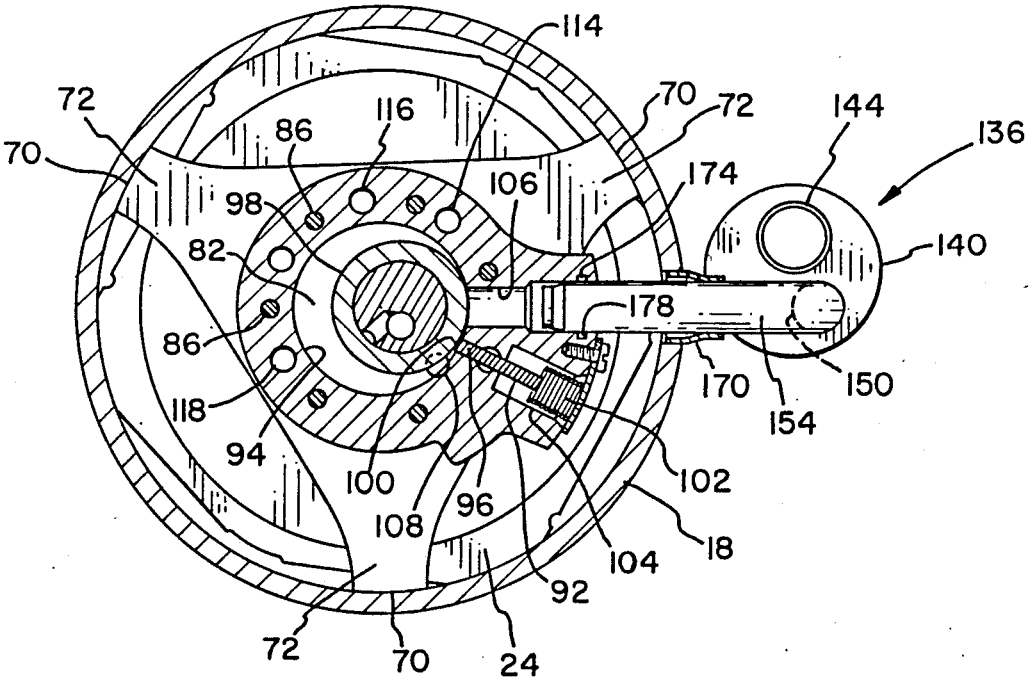
FIG. 2 is a sectional view of the compressor of FIG. 1 taken along the line 2—2 of FIG. 1 and viewed in the direction of the arrows.

Referring now to FIGS. 1 and 2 for a more detailed description of rotary vane compressors 44 and 46 of the present invention, it will be understood that the following detailed description of compressor 44 is equally applicable to compressor 46 with respect to the general structure and operation thereof, with several minor exceptions noted below. Crankshaft 48 is provided with an eccentric portion 58 which revolves around the crankshaft axis as crankshaft 48 is rotatably driven by rotor 26. Counterweight 60 is provided to balance eccentric 58 and is secured to end ring 62 of rotor 26 by riveting. Counterweight 60 is radially disposed 180° apart from eccentric portion 58 for best balance.

Crankshaft 48 is journalled in a main bearing 64 having a cylindrical journal portion 66 and a generally planar portion 68. Planar portion 68 is secured to housing 10 at three points 70 such as by welding of flanges 72 to the housing, as best illustrated in FIG. 2. Compressor 44 comprises a second bearing, outboard bearing 74, disposed axially outwardly of main bearing 64. Outboard bearing 74 is provided with a generally planar portion 76 and a journal portion 78 to rotatably support crankshaft 48 at the distal end thereof.

Located intermediate main bearing 64 and outboard bearing 74 is compressor cylinder block 80. Cylinder block 80 defines a cylinder therein, referred to hereinafter as compression chamber 82. Compressor cylinder block 80, outboard bearing 74, and main bearing 64 are secured together by means of 12 bolts 84, two of which are indicated in FIG. 1. By referring to FIG. 2, it can be seen that six threaded holes 86 are provided in cylinder block 80 for securing bearings 64, 74 and cylinder block 80 together. Of the twelve bolts 84, six of them secure outboard bearing 74 to cylinder block 80 and are threaded into holes 86. The remaining six bolts secure main bearing 64 to cylinder block 80 and are threaded into holes 86. An inner discharge muffler plate 88 is secured to main bearing 64 and an outer discharge muffler plate 90 is secured to outboard bearing 74 by bolts 84, as indicated in FIG. 1.

By referring to FIG. 2, it can be seen that cylinder block 80 has a vane slot 92 provided in the cylindrical side wall 94 thereof into which is received a sliding vane 96. Roller 98 is provided which surrounds eccentric portion 58 of crankshaft 48 and revolves around the axis of crankshaft 48 and is driven by eccentric portion 58. Tip 100 of sliding vane 96 is in continuous engagement with roller 98 as vane 96 is urged against the roller by a spring 102 received in spring pocket 104. During operation, as roller 98 rolls around compression chamber 82, refrigerant will enter chamber 82 through a fluid inlet opening 106 in cylinder block 80. Next, the compression volume enclosed by roller 98, cylinder wall 94, and sliding vane 96 will decrease in size as roller 98 revolves counterclockwise around compression chamber 82, as viewed in FIG. 2. Refrigerant contained in that volume will therefore be compressed and after compression will exit through a relief 108 in sidewall 94. The aforementioned compressor mechanism is presented by way of example only, it being contemplated that other piston means for compressing gas within chamber 82 may be used without departing from the spirit and scope of the present invention.

A discharge gas routing system is included in the disclosed embodiment of the present invention, and provides means for discharging compressed gas from within chamber 82 comprising a pair of discharge ports in communication with chamber 82 and extending through main bearing 64 and outboard bearing 74, respectively. More specifically, compressed refrigerant gas which is discharged through relief 108 flows axially outwardly through discharge ports and valves in both the main bearing and outboard bearing. The gas is then discharged into first and second discharge mufflers comprising muffler chambers 110 and 112 defined by discharge muffler plates 88 and 90 and the outer surfaces of bearings 64 and 74, respectively. A collar portion on muffler plates 88 and 90 sealingly engages over journal portions 66 and 78, respectively, as by a slip-fit.

Further routing of discharge gas from muffler chambers 110 and 112, according to the gas routing system disclosed herein, is as follows. Discharge gas expanded into muffler chamber 110 is routed to chamber 112 through a passageway 114 extending through bearings 64, 74 and cylinder block 80. The resultant combined discharge gas in muffler chamber 112 is then routed back through the bearings and cylinder block by means of a pair of passageways 116 and 118. The discharge gas exits passageways 116 and 118 from the axially inward side of compressor 44 directed toward motor 22 for cooling thereof.

As mentioned previously, the description with respect to compressor 44 is equally applicable to compressor 46 with several minor exceptions. Compressor 46 is synchronously coupled to rotor 26 with its main bearing **64*a* oriented axially inwardly, resulting in compressor 46 being driven in a direction, with respect to the compressor, opposite to that of compressor 44. Accordingly in the disclosed embodiment, main bearing 64*a* and outboard bearing 74*a* of compressor 46 are mirror images of respective bearings 64 and 74 of compressor 44. Likewise, cylinder block 80*a* is identical to cylinder block 80, but is turned over in order to properly cooperate with bearings 64*a* and 74*a***.

Another difference between compressors 44 and 46 is that compressor 46 is provided with a conventional centrifugal oil pump 120 operably associated with outboard bearing **74*a* and the end of crankshaft 50, both of which are submerged in oil sump 122. During operation, oil pump 120 pumps lubricating oil upwardly through an oil passage extending longitudinally through crankshafts 48 and 50, illustrated in FIG. 1 by passageway 124. The oil passages in crankshafts 48 and 50 include openings in the axially inward ends thereof, which open into a space 126 separating the crankshafts in quill 32. Accordingly, oil pump 120 pumps oil from oil sump 122 sequentially through oil passage 124*a* in crankshaft 50, space 126 in quill 32, and oil passage 124 in crankshaft 48. A hole 128 is provided in the sidewall of journal 78 to dump excess oil emerging from oil passage 124 having an opening on the distal end of crankshaft 48. Radial passages in the crankshafts deliver oil from oil passages 124, 124*a* to openings 130, 130*a* in crankshafts 48, 50 to lubricate rollers 98, 98*a***, respectively.

In assembling the twin rotary compressor of the present invention, it is important that crankshafts 48 and 50 be coupled to rotor 26 so that eccentric portions 58 and **58*a* are oriented oppositely one another with respect to the rotor axis of rotation. In other words, the eccentric portions are radially disposed 180° apart to achieve best dynamic balance and motor loading. Several ways of assembling compressor assembly 10 to achieve the aforementioned balance are contemplated. However, the preferred method of assembly includes first press fitting or shrink fitting shaft 50 within quill 32 so that eccentric portion 58*a* is properly positioned with respect to channel 54. Crankshaft 48 is then introduced into quill 32 in slip fitting fashion and is radially aligned so that key 56 may be engaged, thereby insuring the proper orientation of the eccentric portions 58 and 58*a*** with respect to one another.

As discussed previously, counterweights 60 and **60*a* are provided on end rings 62 and 62*a* to balance eccentric portions 58 and 58*a*, respectively. Counterweights 60 and 60*a* are radially disposed 180° apart from their adjacent eccentric portion 58 and 58*a*, which are themselves radially disposed 180° apart from one another. Accordingly, a staggered configuration is achieved, whereby moving axially from one end of compressor 10 to the other, the eccentric portions and counterweights alternate 180° apart from one another, as illustrated in FIG. 1**. This provides optimal dynamic balance of the composite rotating mass.

As an aid to engaging and stopping the penetration of crankshafts 48 and 50 into opposite ends of quill 32 during compressor assembly, snap rings 132 and 134 are attached to crankshafts 48 and 50, respectively, by means of a conventional annular groove provided therein. With the snap rings positioned on the crankshafts axially inwardly from the main bearings, the snap ring will abut the end of the quill, thus stopping further penetration of the crankshaft and establishing proper axial spacing between the compressors. It is appreciated that annular shoulders formed on crankshafts 48 and 50 may be used instead of snap rings 132 and 134 to provide stop means for limiting axial penetration of the crankshafts into the quill.

The twin rotary compressor 10 of the present invention, in one form thereof, incorporates a suction accumulator 136 external to housing 12, comprising a generally cylindrical central portion 138, a top end portion 140, and a bottom end portion 142. The three accumulator portions are hermetically secured together as by welding or brazing. A vessel inlet for receiving gas and liquid refrigerant from a refrigeration system (not shown) is provided in top end portion 140, and is represented in FIG. 1 by inlet tube 144 extending through end portion 140. Inlet tube 144 is secured to end portion 140 by welding or brazing. End 146 of inlet tube 144 extends into the interior of accumulator 136 and includes a cylindrical screen filter portion 148.

Accumulator 136 is further provided with a pair of fluid outlets, represent in the preferred embodiment of the figures by flanged openings 150 and 152 in end portions 140 and 142, respectively. Openings 150 and 152 are axially aligned with one another along an axis parallel to and offset from the central longitudinal axis of accumulator 136, as shown in FIG. 2. FIG. 2 also shows inlet tube 144 entering top end portion 140 at a location off center.

A pair of conduits, shown as cylindrical tubes 154 and 156, constitute means for providing fluid communication between openings 150, 152 and fluid inlet openings 106, **106*a* of compressors 44 and 46, respectively. Ends 158 and 160 of tubes 154 and 156 extend through openings 150 and 152 into the interior of accumulator 136, respectively. It can be seen in the vertically oriented accumulator of FIG. 1 that ends 158 and 160 terminate in the upper half of accumulator 136**, which represents the gaseous region of the accumulator, thereby preventing introduction of liquid refrigerant into the compressors.

Tubes 154 and 156 extend axially outwardly from opposing ends of accumulator 136 and are given respective 90° bends 162 and 164 so as to approach central portion 18 of housing 12 at a substantially perpendicular angle. Central portion 18 is provided with spaced apertures 166 and 168 positioned substantially adjacent to fluid inlets 106 and **106*a*, respectively. In FIG. 1, adjacent positioning of apertures 166 and 168 means radially outwardly of inlets 106 and 106*a* so that tubes 154 and 156 may be inserted therethrough and received within inlets 106 and 106*a***, respectively.

Cylindrical soldering flanges 170 and 172 secure tubes 154 and 156 to housing 12 and conduct heat away from the tubes as they are soldered to the housing. Tubes 154 and 156 are sealed to fluid inlets 106 and **106*a* by means of O-rings 174 and 176 housed in annular recesses 178 and 180 of the cylinder walls of cylinder blocks 80 and 80*a***, respectively.

The method of assembling twin rotary compressor 10 to incorporate suction accumulator 136, according to the present invention, includes the following steps subsequent to providing apertures 166 and 168 in housing 12 substantially adjacent to fluid inlets 106 and **106*a*. According to the preferred method, tube 156 is inserted in flanged opening 152 and is affixed thereto. Tube 154 is inserted in flanged opening 150 and is left slidingly engaged therewith. Accumulator 136 is then positioned generally parallel to housing 12, and fixed tube 156 is positioned adjacent aperture 168 while sliding tube 154 is axially adjusted to align with aperture 166. Once aligned, tubes 154 and 156 are inserted through apertures 166 and 168 into fluid inlets 106 and 106*a*, respectively, and are sealingly engaged therein by O-rings 174 and 176. Tube 154 is then fixed to flanged opening 150, and tubes 154 and 156 are positively affixed to housing 12 at the location of apertures 166 and 168 to mount accumulator 136 to housing 12** without the need for additional mounting brackets.

With respect to the method of assembling accumulator 136 to the housing, it is also contemplated that tubes 154 and 156 may be axially positioned and affixed to respective flanged openings 150 and 152 prior to being inserted into spaced apertures 166 and 168. Furthermore, tubes 154 and 156 may both be slidingly engaged with respective openings 150 and 152 during assembly.

It should be pointed out that the present invention, as inherent from the disclosed embodiment, may provide for the pair of compressors to cooperatively function so that a compression stroke for one of the compressors occurs 180° of crankshaft rotation out-of-phase with the completion of a corresponding compression stroke for the other compressor. More specifically, in the disclosed embodiment wherein a pair of rotary vane compressors are mirror images to one another and the eccentric portions are radially disposed 180° apart, the described compression stroke balancing occurs. Accordingly, the twin rotary compressor of the present invention experiences two compression pulses during each revolution, similar to a twin cylinder reciprocating piston compressor. This performance feature is advantageous in terms of improving motor loading conditions.

It is appreciated that the twin rotary compressor of the present invention permits the same tooling used for manufacturing a single rotary compressor unit to be used in manufacturing an assembly having double the displacement capacity. However, the requirement of a larger motor for use in the twin rotary compressor assembly may require a larger diameter housing, thus necessitating larger diameter flanges for the compressor bearings in order for them to peripherally mount within the housing.

It will be appreciated that the foregoing is presented by way of illustration only, and not by way of any limitation, and that various alternatives and modifications may be made to the illustrated embodiment without departing from the spirit and scope of the invention.

What is claimed is:

1. A hermetic compressor assembly, comprising:

a housing;

drive means disposed within said housing for providing a pair of synchronous axially opposed rotary outputs, said drive means comprising a rotatable rotor;

a pair of positive displacement compressors, each having a rotary input comprising a rotatable crankshaft;

coupling means for coupling both said crankshafts to said rotor, including a quill coaxially disposed within said rotor to receive and drivingly engage said crankshafts therein; and stop means associated with each of said crankshafts for limiting the axial penetration of a respective crankshaft into a respective end of said quill, said stop means comprising abutment means on each of said crankshafts for abutting a respective end of said quill.

2. The hermetic compressor assembly of claim 1 in which said housing is vertically upstanding, and said axially opposed rotary outputs are rotatable about a vertical axis.

3. The hermetic compressor assembly of claim 1 in which:

one of said crankshafts is engaged with said quill by an interference fit therebetween and the other of said crankshafts is engaged with said quill by key means for preventing relative rotational movement therebetween.

4. The hermetic compressor assembly of claim 1 in which:

said abutment means comprises a snap ring attached to each of said crankshafts.

5. The hermetic compressor assembly of claim 1 in which: said pair of compressors are rotary vane compressors.

6. A hermetic compressor assembly, comprising:

a housing;

an electric motor operatively disposed within said housing and having a rotor rotatable about an axis of rotation;

a pair of compressor mechanisms, each including a crankshaft having an eccentric portion thereon;

coupling means for coaxially coupling said crankshafts to said rotor in opposing axial directions along said axis of rotation with said eccentric portions positioned on opposite sides of said axis of rotation, said coupling means comprising a quill coaxially disposed within said rotor into which said crankshafts are received at respective ends thereof; and stop means associated with each of said crankshafts for limiting the axial penetration of a respective crankshaft into a respective end of said quill, said stop means comprising abutment means on each of said crankshafts for abutting a respective end of said quill.

7. The hermetic compressor assembly of claim 6 wherein said housing is vertically upstanding and includes an oil sump in a bottom portion thereof, and said rotor is rotatable about a vertical axis of rotation along which said crankshafts extend in opposing axial directions, and further comprising:

oil pump means for pumping oil from said oil sump to said pair of compressor mechanisms, said oil pump means including an oil passage extending longitudinally through each of said crankshafts.

8. The hermetic compressor assembly of claim 6 in which:

said abutment means comprises a snap ring attached to each of said crankshafts.

9. The hermetic compressor assembly of claim 6 wherein said eccentric portions have rotating mass, and further comprising:

counterbalancing means associated with said rotor for balancing the rotating masses of said eccentric portions.

10. The hermetic compressor assembly of claim 9 in which:

said counterbalancing means comprises a pair of weights attached to said rotor at axially opposed ends thereof, each of said pair of weights being mounted oppositely said eccentric portion located adjacent thereto, with respect to said axis of rotation.

11. The hermetic compressor assembly of claim 7 in which:

each said oil passage includes an opening into said quill, said oil pump means further comprising said quill, whereby oil from said sump is pumped through one of said oil passages to the other through said quill.

12. A hermetic compressor assembly, comprising:

a housing;

an electric motor operatively disposed within said housing including a rotatable rotor having axially opposed ends;

a pair of positive displacement compressor mechanisms, each of said mechanisms comprising a compression chamber, a crankshaft having an eccentric portion thereon, and piston means within said chamber drivingly connected to said eccentric portion for compressing gas within said compression chamber during compression stroke;

coupling means for drivingly coupling each of said crankshafts to a respective one of said axially opposed ends with said crankshafts oriented so that the completion of a compression stroke for one of said compressor mechanisms occurs 180° of crankshaft rotation out-of-phase with the completion of a corresponding compression stroke for the other compressor mechanism, said coupling means comprising a quill coaxially disposed within said rotor to receive and drivingly engage said crankshafts therein; and stop means associated with each of said crankshafts for limiting the axial penetration of a respective crankshaft into a respective end of said quill, said stop means comprising abutment means on each of said crankshafts for abutting a respective end of said quill.

13. The hermetic compressor assembly of claim 12 in which:

said abutment means comprises a snap ring attached to each of said crankshafts.

14. The hermetic compressor assembly of claim 12 in which said housing is vertically upstanding, and said rotor is rotatable about a vertical axis of rotation.

* * * * *